United States Patent [19]

Voss et al.

[11] Patent Number: 4,641,703

[45] Date of Patent: Feb. 10, 1987

[54] COUNTERGRAVITY CASTING MOLD AND CORE ASSEMBLY

[75] Inventors: Karl D. Voss, Standish; Mark A. Datte, Auburn; Gary F. Ruff, Saginaw, all of Mich.

[73] Assignee: General Motors Corporation, Detroit, Mich.

[21] Appl. No.: 802,423

[22] Filed: Nov. 27, 1985

[51] Int. Cl.[4] ..... B22D 18/06

[52] U.S. Cl. ..... 164/255; 164/306; 164/340; 164/361; 164/365

[58] Field of Search ..... 164/255, 254, 253, 256–258, 164/61–63, 65, 340, 306, 361, 365

[56] References Cited

U.S. PATENT DOCUMENTS

| | | | |
|---|---|---|---|
| 1,298,373 | 3/1919 | Mott, Jr. et al. | 164/365 X |
| 1,531,445 | 3/1925 | Lake | 164/255 |
| 2,312,796 | 3/1943 | Campbell | 164/255 |
| 3,540,516 | 11/1970 | Taccone | 164/61 |
| 4,340,108 | 7/1982 | Chandley et al. | 164/63 |

FOREIGN PATENT DOCUMENTS

| | | | |
|---|---|---|---|
| 116964 | 1/1946 | Australia . | |
| 505497 | 10/1976 | U.S.S.R. | 164/365 |

*Primary Examiner*—Nicholas P. Godici
*Assistant Examiner*—J. Reed Batten, Jr.
*Attorney, Agent, or Firm*—Lawrence B. Plant

[57] ABSTRACT

Apparatus for the countergravity, shell-mold casting process comprising a gas-permeable shell mold sealed in the mouth of a vacuum chamber and a hollow, expendable, gas-permeable, thermally degradable, core disposed with the molding cavity for engulfment and retention by the metal being cast. The core defines a central evacuation cavity and an unobstructed vent for exhausting the evacuation cavity into the vacuum chamber such that the pressure in the evacuation cavity is substantially equal to that in the vacuum chamber during casting.

4 Claims, 2 Drawing Figures

COUNTERGRAVITY CASTING MOLD AND CORE ASSEMBLY

This invention relates to countergravity casting of metal in gas-permeable, shell molds and more particularly to thermally degradable, retained, expendable cores therefor.

BACKGROUND OF THE INVENTION

The countergravity, shell mold, casting process is particularly useful in the making of thin-wall castings and involves: sealing a bottom-gated shell mold, having a gas-permeable upper portion, (e.g., cope) to the mouth of a vacuum chamber such that the chamber encompasses the upper portion; immersing the underside of the mold in an underlying melt; and evacuating the chamber to draw melt up into the mold through one or more of the gates in the underside thereof. Such a process is shown in U.S. Pat. No. 4,340,108 wherein the mold comprises a resin-bonded-sand shell having cope and drag portions defining a molding cavity therebetween. Many castings made by such a process require the use of an expendable, retained core disposed within the mold cavity to shape the inside of the casting, such cores are engulfed by the melt, initially retained within the casting and finally removed as, for example, by disintegration. It is known to use hollow retained cores to reduce the amount of core material and to facilitate core removal.

Retained cores typically have a mounting extension on at least one end thereof which is anchored to the mold shell (i.e., usually at the parting line between the shell halves) to position the core in the molding cavity and support it against movement therein as the melt flows about it. Heretofore, the mounting extension has been simply buried deep within the material forming the mold shells, and, for thermally stable core materials (e.g., quartz), this is an acceptable way to mount the core. Such materials, however, are quite expensive especially in complicated shapes. Less expensive core materials such as resin-bonded-sand (e.g., hot-box, cold-box, shell etc.), or the like, on the other hand, can be formed into virtually any core shape desired and hence give the mold maker considerable flexibility. However, resin-bonded-sand core materials are thermally degradable in that the resin binder breaks down to form gases under the heat of the melt. With respect to such thermally-degradable, retained cores, we have found that the gases generated by the breakdown of the binder during casting is trapped by the surrounding metal and hence cannot escape the molding cavity through the walls of the gas-permeable shell walls. Rather, these trapped gases tend to become detrimentally occluded (e.g., as internal voids or surface pits) in the casting.

It is therefore an object of the present invention to provide an improved countergravity casting apparatus of the above-described type which is so constructed and arranged as to vent the breakdown gases generated by thermally-degradable, retained cores engulfed by metal within the molding cavity and thereby avoid occlusion of the gases in the finished casting. This and other objects and advantages of the present invention will become more readily apparent from the detailed description thereof which follows.

BRIEF DESCRIPTION OF THE INVENTION

The present invention comprehends a countergravity, shell mold casting apparatus including essentially: a vacuum chamber; a shell mold having a gas-permeable upper portion (e.g., cope) secured to a bottom-gated lower portion (e.g., drag) and sealed in the mouth of the vacuum chamber; and a hollow, thermally-degradable, gas-permeable, expendable, retained core having an internal evacuation cavity which is vented to the vacuum chamber via a substantially unobstructed gas-flow passage. More specifically, the thermally degradable core material (e.g., resin-bonded-sand) forms an appropriately shaped shell defining an internal evacuation cavity. The core has a mounting extension on at least one end thereof and the evacuation cavity is unobstructedly vented to the vacuum chamber via a passage through the extension such that the pressure in the evacuation cavity during casting is as near to the reduced pressure in the vacuum chamber as is possible. As a result, any gases formed by the thermal degradation of the core material by the surrounding melt are immediately sucked through the gas-permeable core shell into the evacuation cavity and exhausted to the vacuum chamber thereby preventing occlusion thereof in the casting. The core's evacuation cavity will preferably communicate with the vacuum chamber as directly as possible, as by bringing the core extension, and hence the vent passage therethrough, through the mold shell to the surface of the mold in the vacuum chamber. Where this is not possible, the evacuation cavity may be vented indirectly by an opening in the shell formed as by boring a supplemental passage through the mold shell into registry with the passage to the evacuation cavity through the core extension. Boring vent passages requires: precise fixturing of the part to insure that the bore accurately meets the passage through the extension; and an additional processing step. Hence direct venting is preferred wherever the part design will permit.

BRIEF DESCRIPTION OF THE DRAWING

The present invention may better be understood when considered in the light of the following detailed description of certain specific embodiments thereof which are described hereafter in conjunction with the drawings wherein.

DETAILED DESCRIPTION OF PREFERRED EMBODIMENTS

Figure 1:
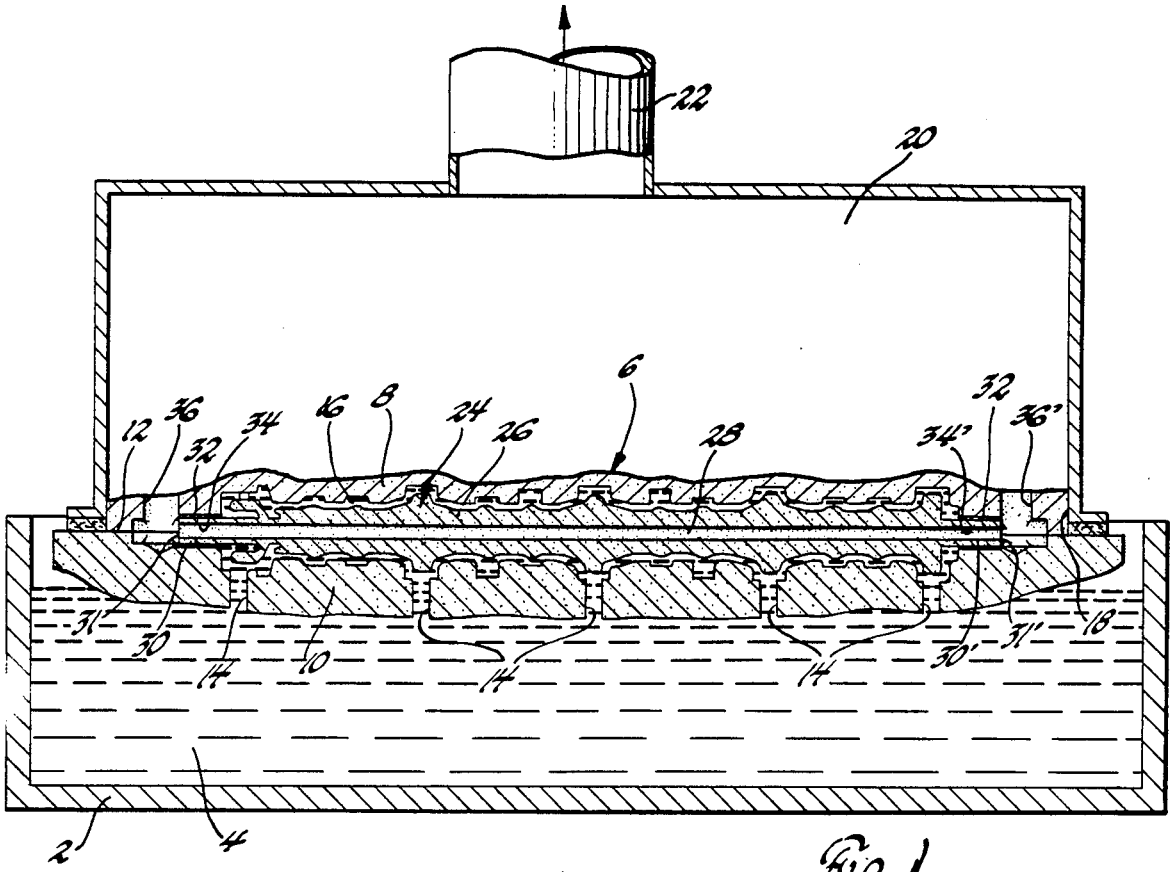
FIGS. 1 and 2 are sectioned, side views, of countergravity, shell mold casting apparatus in accordance with the present invention.
Figure 2:
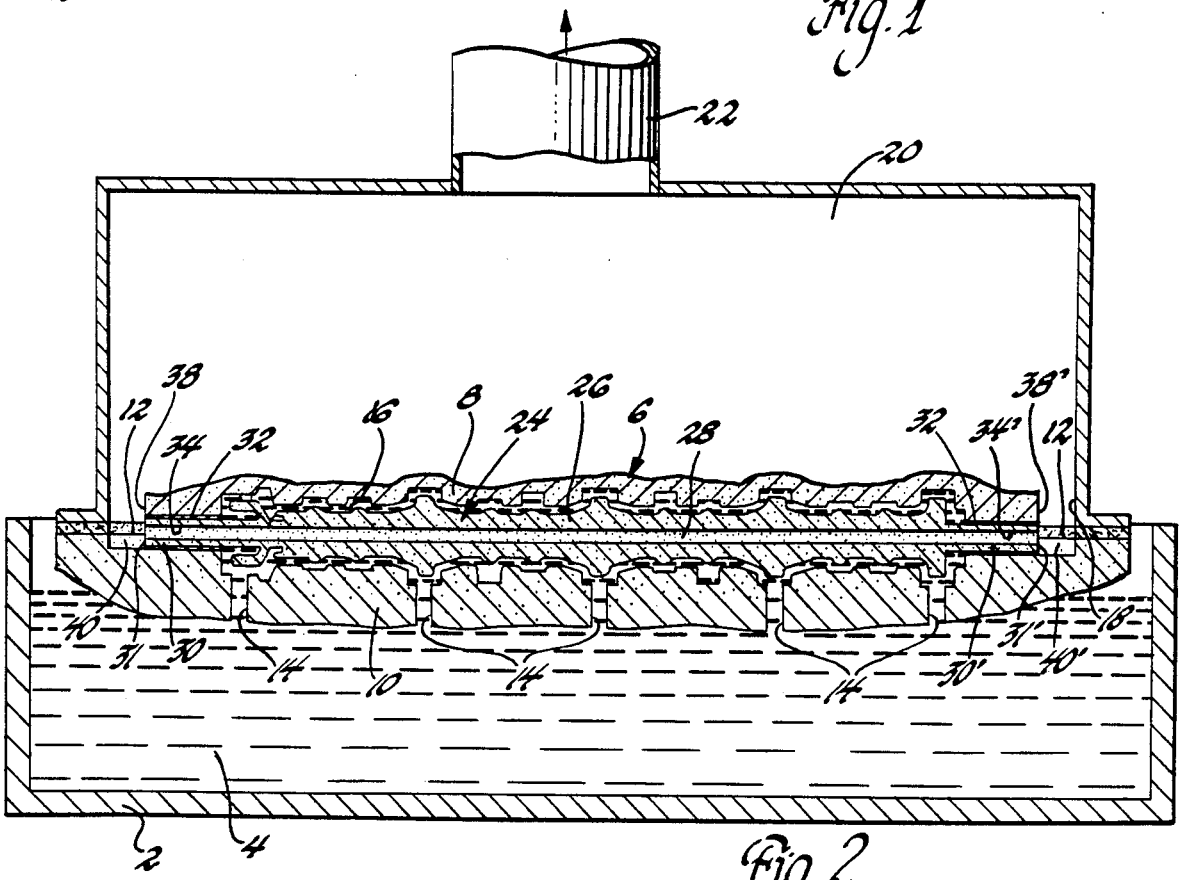

While FIGS. 1 and 2 disclose different embodiments of the present invention, they are best described using the same reference numerals for like parts, where applicable. In this regard, the embodiments shown in FIGS. 1 and 2 differ only with respect to how (i.e., indirectly or directly, respectively) the hollow cores are vented to the vacuum chamber. More specifically, FIGS. 1 and 2 disclose a pot 2 of metal melt 4 which is to be drawn up into the mold 6. The mold 6 includes a first portion 8 joined (e.g., glued) to a second lower portion 10 along a parting line 12 and define therebetween a molding cavity 16. The lower portion 10 includes a plurality of ingates 14 on the underside thereof for supplying melt to the mold cavity 16. The lower portion 10 of the mold 6 is sealed to the mouth 18 of the vacuum chamber 20 such that the gas-permeable upper portion 8 is encompassed by the chamber 20. The vacuum chamber 20 is communicated to a vacuum source (not shown) via conduit 22. The upper portion 8 of the mold 6 comprises a gas-permeable material (e.g., resin-bonded-sand) which permits gases to be withdrawn or evacuated from the casting cavity 16 when a vacuum is drawn in the chamber 20. The lower portion 10 of the mold 6 may conveniently comprise the same material as the upper portion 8, or other materials, permeable or impermeable, which are compatible with the upper portion material. An expendable, retained hollow core 24 comprising a gas-permeable, thermally-degradable shell 26 defining an internal evacuation cavity 28 is positioned substantially centrally within the casting cavity 16 of the mold 6 and is completely engulfed by the melt during filling. The core 24 includes extensions 30 and 30' on the opposite ends thereof which are secured (i.e., by glue 32) to the mold 6 in recesses previously molded into the upper and lower portions 8 and 10 at the parting line 12. Passages 34 and 34' through the centers of the extensions 30 and 30' respectively communicate the evacuation cavity 28 with outboard ends 31 and 31' of the extensions 30 and 30'. In some instances depending on the design of the casting, a single core extension may be sufficient to locate and immovably anchor the core in the molding cavity. Indeed some castings may permit the use of only one core extension in order to meet design requirements.

In the embodiment shown in FIG. 1, the ends 31 and 31' of the extensions 30 and 30' are buried deep within the mold and hence the passages 34 and 34' would normally be obstructed by the mold material if it were not for the present invention. In accordance with this invention, bores 36 and 36' are provided through the upper portion 8 of the mold 6 so as to indirectly provide unobstructed communication between the evacuation cavity 28 and the vacuum chamber 20 via the passages 34 and 34'.

In the embodiment shown in FIG. 2, the upper shell portion 8 of the mold 6 is formed so as to be peripherally smaller than the mouth 18 of the chamber 20. In this embodiment, the core extensions 30 and 30' extend completely through the upper shell 8 so as to exit on the outside surface 38 and 38' thereof. This permits the passages 34 and 34' to vent the evacuation cavity 28 directly to the vacuum chamber 20. In this embodiment, recesses 40 and 40' which were formed in the lower portion of the mold 10 to receive extensions 30 and 30' are elongated sufficiently so as not to block the passages 34 and 34' and therefore to insure that there are no obstructions to interfere with gas flow out of the evacuation cavity 28.

Needless to say, the hollow cores in accordance with the present invention need not necessarily lie horizontally in the molding cavity but may assume a variety of orientations (e.g., vertical, oblique, etc.) and may be affixed to the mold at many locations (e.g., depend from the top) without departing from the essence of the present invention. Hence, while the invention has been disclosed primarily in terms of two specific embodiments thereof it is not intended to be limited thereto but rather only to the extent set forth hereafter in the claims which follow.

The embodiments of the invention in which an exclusive property or privilege is claimed are defined as follows:

1. Apparatus for the countergravity casting of molten metal comprising:

a mold comprising a porous, gas-permeable upper shell defining a molding cavity and a lower portion secured to said upper shell, said lower portion having at least one gate on the underside thereof for admitting said molten metal to said molding cavity from an underlying pot thereof;

a vacuum chamber overlying said upper shell and sealingly engaging said mold for withdrawing gases from said molding cavity substantially uniformly through said shell and such as to suck said metal up into said cavity via said gate;

a discrete, hollow, expendable core disposed within said molding cavity to shape said metal thereabout, said core being destined for engulfment and temporary retention by said metal and comprising a porous, gas-permeable, thermally degradable shell defining an evacuation cavity for withdrawing gases from said molding cavity which are formed upon degradation of said core while engulfed by said metal during casting;

an extension on said core, said extension projecting from at least one end thereof and sealingly engaging said mold; and an unobstructed gas flow passage through said extension connecting said evacuation cavity and said vacuum chamber for establishing a pressure in said evacuation cavity casting which is substantially equal to the pressure in said chamber; whereby gases generated by the thermal degradation of said core are withdrawn from said molding cavity into said chamber via said evacuation cavity and passage and occlusion thereof in the metal casting thereby prevented.

2. Apparatus for the countergravity casting of molten metal comprising:

a mold comprising a porous, gas-permeable upper shell defining a molding cavity and a lower portion secured to said upper shell, said lower portion having at least one gate on the underside thereof for admitting said molten metal to said molding cavity from an underlying pot thereof;

a vacuum chamber overlying said upper shell and sealingly engaging said mold for withdrawing gases from said molding cavity substantially uniformly through said shell and such as to suck said metal up into said cavity via said gate;

a discrete, hollow, expendable core disposed within said molding cavity to shape said metal thereabout, said core being destined for engulfment, and temporary retention by said metal and comprising a porous, gas-permeable, thermally degradable shell defining an evacuation cavity for withdrawing gases from said molding cavity which are formed upon degradation of said core while engulfed by said metal during casting;

an extension on said core, said extension projecting from at least one end thereof and sealingly engaging said mold;

a gas flow passage through said extension and communicating with said evacuation cavity; and a opening in said upper shell connecting said passage and said vacuum chamber for maintaining a pressure in said evacuation cavity during casting which is substantially equal to the pressure in said chamber; whereby gases generated by the thermal degradation of said core are withdrawn from said molding cavity into said chamber via said evacuation cavity, passage and bore and occlusion thereof in the metal casting thereby prevented.

3. Apparatus for the countergravity casting of molten metal comprising:

a mold comprising a porous, gas-permeable upper shell defining a molding cavity and a lower portion secured to said upper shell, said lower portion having at least one gate on the underside thereof for admitting said molten metal to said molding cavity from an underlying pot thereof;

a vacuum chamber overlying said upper shell and sealingly engaging said mold for withdrawing gases from said molding cavity substantially uniformly through said shell and such as to suck said metal up into said cavity via said gate;

a discrete, hollow, expendable core disposed within said molding cavity to shape said metal thereabout, said core being destined for engulfment and temporary retention by said metal and comprising a porous, gas-permeable, thermally degradable shell defining an evacuation cavity for withdrawing gases from said molding cavity which are formed upon degradation of said core while engulfed by said metal during casting;

an extension on said core sealingly engaging said shell, said extension extending through said shell into communication with said chamber; and an unobstructed gas flow passage through said extension connecting said evacuation cavity and said vacuum chamber for establishing a pressure in said evacuation cavity during casting which is substantially equal to the pressure in said chamber; whereby gases generated by the thermal degradation of said core are withdrawn from said molding cavity into said chamber via said evacuation cavity and passage and occlusion thereof in the metal casting thereby prevented.

4. Apparatus for shaping a metal article in a bottom-gated, expendable shell mold by the vacuum-induced, countergravity casting method wherein the underside of the mold is immersed in an underlying melt of metal and the mold evacuated to draw said melt up into said mold, said apparatus comprising:

a first portion of said mold comprising a porous, gas-permeable, shell defining a mold cavity for shaping said article;

a second portion of said mold sealed to said first portion and further defining said cavity;

a vacuum chamber having a peripheral edge defining a mouth for receiving and sealingly engaging said mold such that said chamber encompasses a substantial proportion of the external surface area of said first portion for withdrawing gases from said mold cavity substantially uniformly through said first portion during casting;

a discrete, hollow, expendable core disposed within said mold cavity to further shape said metal thereabout, said core being destined for engulfment and temporary retention by said metal and comprising a porous, gas-permeable, thermally degradable shell defining an evacuation cavity for withdrawing gases from said mold cavity which are formed upon degradation of said core during casting;

an extension on said core projecting from at least one end thereof and sealingly engaging said mold;

an unobstructed gas-flow passage extending through said extension and said mold and between said evacuation cavity and said vacuum chamber for establishing a pressure in said evacuation cavity during casting which is substantially equal to the pressure in said chamber; and means for evacuating said chamber sufficiently to draw said melt up into said mold after it is immersed in said melt;

whereby gases generated in said mold cavity by the thermal degradation of said core are withdrawn from said mold cavity into said chamber via said evacuation cavity and passage and occlusion thereof in the metal is thereby prevented.

* * * * *